United States Patent [19]

Kometani et al.

[11] 3,960,057

[45] June 1, 1976

[54] HYDRAULIC PUMP OR MOTOR

[75] Inventors: Eiji Kometani; Masaya Imai, both of Tokyo; Eiichi Hazaki, Kashiwa, all of Japan

[73] Assignee: Hitachi Construction Machinery Co., Ltd., Japan

[22] Filed: Jan. 23, 1974

[21] Appl. No.: 435,954

[30] Foreign Application Priority Data

Jan. 26, 1973 Japan ..... 48-10322

[52] U.S. Cl. ..... 92/160; 91/488

[51] Int. Cl.[2] ..... F01B 31/10

[58] Field of Search ..... 92/160, 159, 158; 91/488

[56] References Cited

UNITED STATES PATENTS

| | | | |
|---|---|---|---|
| 2,862,455 | 12/1958 | Ferris | 91/488 |
| 3,106,138 | 10/1963 | Thoma | 92/160 |
| 3,153,987 | 10/1964 | Thoma | 92/160 |
| 3,168,013 | 2/1965 | Williamson | 92/160 |
| 3,366,017 | 1/1968 | Firth et al. | 92/158 |
| 3,741,077 | 6/1973 | Hulsebus | 92/158 |
| 3,858,487 | 1/1975 | Abe | 91/488 |

FOREIGN PATENTS OR APPLICATIONS

| | | | |
|---|---|---|---|
| 580,543 | 9/1946 | United Kingdom | 92/158 |

*Primary Examiner*—Paul E. Maslousky
*Attorney, Agent, or Firm*—Craig & Antonelli

[57] ABSTRACT

A hydraulic pump or motor having: oil grooves in the internal partial-spherical surface of a piston for introducing pressure oil between said internal partial-spherical surface and a ball; oil grooves in the peripheral surface of the large diameter portion of said piston for introducing pressure oil between the outer peripheral surface of the large diameter portion of said piston and a cylinder; small diameter passages provided through said piston and extending from the upper end of said piston to said oil grooves, while communicating with an oil chamber for said piston; and necked or throttle portions provided in said small diameter passages, respectively, to thereby give rise to pressure drops for oil which is passing through said small diameter passages.

6 Claims, 16 Drawing Figures

HYDRAULIC PUMP OR MOTOR

This invention relates to a hydraulic pump or motor which provides improved sliding characteristic for a combination of an internal partial-spherical surface of a piston and a ball and for another combination of the piston and a cylinder, which are provided in sliding relation, respectively.

A radial piston type hydraulic pump or motor of a conventional type wherein a rotor 4 incorporates pistons which respectively receive or mount a ball 3 adapted to roll along a wave-form cam surface 1 as shown in FIG. 1, is utilized as a hydraulic motor by supplying oil under high pressures so as to rotate the rotor 4, and also is utilized as a hydraulic pump by rotating the rotor 4 for feeding a high pressure oil.

In the pump or motor, however, the sliding contact surfaces defined between the internal partial-spherical surface of the piston 3 and the ball 2, and between the piston 3 and the surface of the cylinder are highly pressed against one another, since the ball 2 is subjected to a reaction force F from the slant faces of the wave-form cam surface 1.

Accordingly, in order to utilize said hydraulic pump or motor in a high load condition, it is necessary to form oil films between the internal partial-spherical surface of the piston 3 and the ball 2 as well as between the piston 3 and the cylinder, and, in addition, to feed oil under high pressure to the gaps defined therebetween, which oil pressure is against the sidewise component of the reaction force successively varying in the direction.

In view of the above-described requirements, there have been proposed a number of devices which improved sliding characteristics between a piston and a cylinder receiving the piston. Some of these priorart devices are disclosed in Donald Firth et al. U.S. Pat. No. 3,142,262, issued July 28, 1964, John, H. Johnson's U.S. Pat. No. 3,228,346, issued Jan. 11, 1966, and Karl, Eickmann's U.S. Pat. No. 3,255,706, issued June 14, 1966. The applicant of the present invention has also proposed some of these devices in the following Japanese Utility Model Publications; 34888/1972, published Oct. 23, 1972 and invented by Katsuro Abe and Kozo Ono, 34889/1972, published Oct. 23, 1972 and invented by Katsuro Abe and Kozo Ono, 19773/1972, published July 5, 1972, and invented by Katsuro Abe and Kozo Ono, 564/1973, published Jan. 9, 1973, and invented by Katsuro Abe, Kozo Ono and Eizo Kometani.

It is accordingly an object of the present invention to provide a hydraulic pump or motor which may be used under a high load condition with a high efficiency.

It is a further object of the present invention to provide a hydraulic pump or motor characterized in that there is provided at least one oil groove in the internal partial-spherical surface of a piston which receives or mounts a ball thereon and there are formed a plurality of oil grooves which are equally spaced in the outer peripheral surface of a large diameter portion of said piston, said oil grooves being in communication through small diameter passages extending through said piston with an oil chamber, and said passages having necked portions therein.

It is a still further object of the present invention to provide a hydraulic pump or motor in which all the small diameter passages are arranged only in the piston for feeding pressure oil to sliding portions of the ball and internal partial-spherical surface as well as of the piston and cylinder.

It is a further object of the present invention to provide a hydraulic pump or motor of which the manufacture and machining can be facilitated to the advantage of the practical application.

These and other objects and features of the invention will now be clear from a reading of the ensuring part of the specification in conjunction with drawings which indicate embodiments of the invention.

Figure 1:
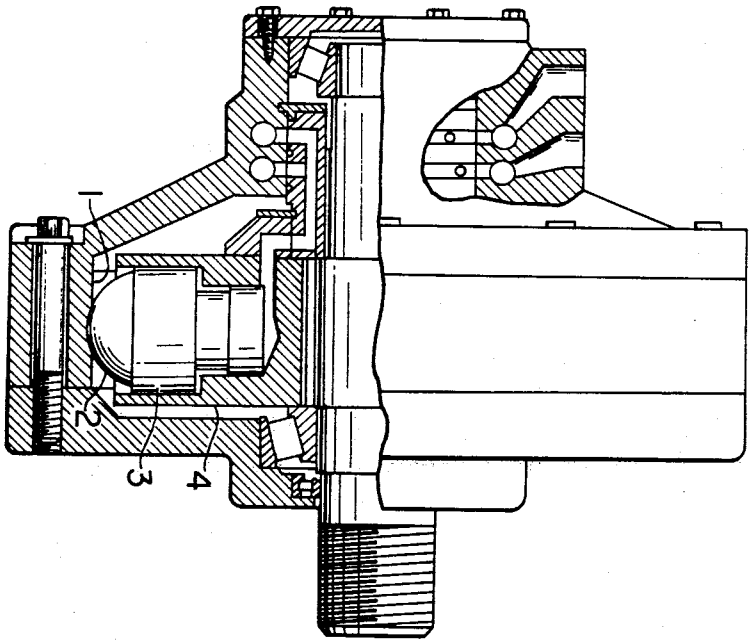
FIG. 1 is a plan view, partly broken, of a radial piston type hydraulic pump or motor of a conventional type.
Figure 2:
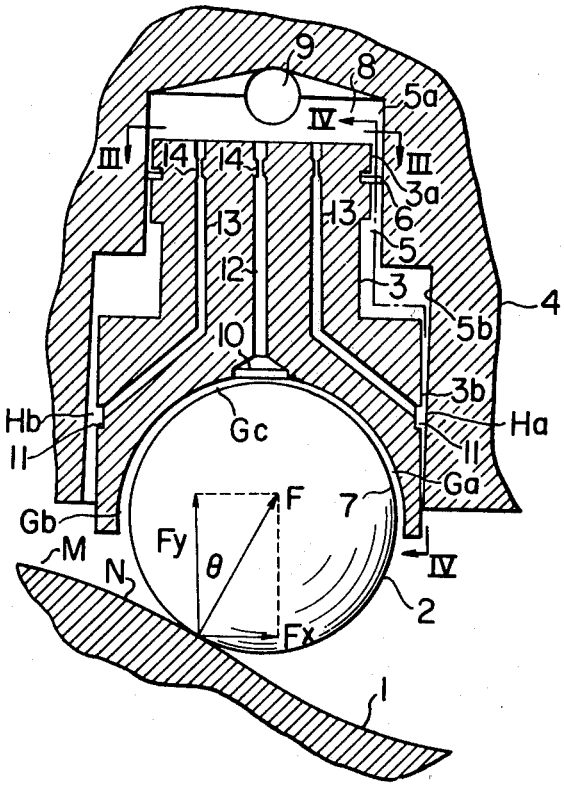
FIG. 2 is a view showing one embodiment of a piston portion of a hydraulic pump or motor of the invention.
Figure 3:
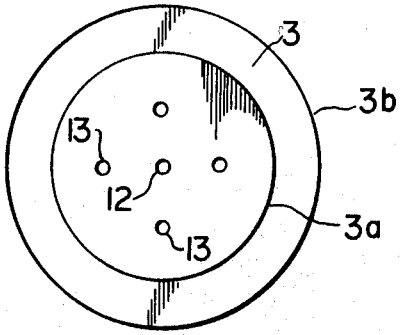
FIG. 3 is a cross-sectional view taken along the line III — III of FIG. 2.
Figure 4:
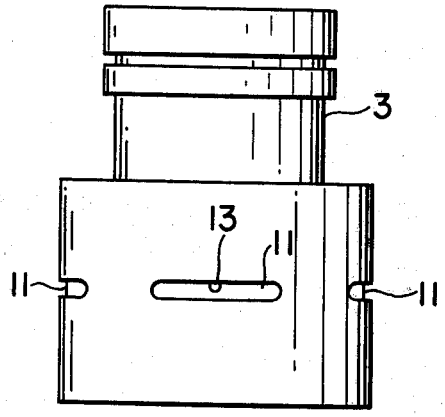
FIG. 4 is a cross-sectional view taken along the line IV — IV of FIG. 2.

Referring to FIGS. 2 and 3, there is shown a piston portion of a hydraulic pump or motor taken as the first embodiment of the invention. In these figures, the similar parts are given the same reference numerals as those in FIG. 1. Reference numeral 5 designates a plurality of cylinders radially extending within a rotor 4, and a cylinder 5 is provided with a small diameter portion 5*a* in a position close to the center of the rotor 4 and a large diameter portion 5*b* on the radially outer side thereof. The piston 3 is slidably fitted in the cylinder 5, with the small diameter portion 3*a* being provided with oil seal 6 in the outer peripheral surface thereof, and with the large diameter portion 3*b* being formed with an internal partial-spherical surface 7 which receives or mounts a ball 2 thereon. Reference numeral 8 designates an oil chamber for the piston 3, and reference numeral 9 an oil passage comminucating with the oil chamber 8. As the rotor 4 rotates, the oil passage 9 is brought into communication with an oil feeding passage or oil discharging passage. Provided at the center of the internal partial-spherical surface 7 of said piston 3 is an oil groove 10 of a conical shape. As shown in FIG. 4, there are provided four grooves 11 which are circumferentially equally spaced on the outer peripheral surface of the large diameter portion 3*b*. The oil grooves 10 and 11, as shown in FIGS. 2 and 3, are in communication through small diameter passages 12 and 13 with the oil chamber 8 for the piston 3. There are provided necked or throttle portions 14 within said small diameter passages 12 and 13 close to the oil chamber 8 for the piston 3.

These necked portions have a tendency to cause a substantial pressure loss thereacross due to the flow of pressure oil through said passages 12 and 13, and to cause no pressure loss in case of the absence of the flow of pressure oil in the passages 12 and 13. By utilizing this tendency, high pressure oil is fed to the oil groove 10 on the internal partial-spherical surface 7, against which is urged the ball 2 due to a reaction force to be described hereinafter, as well as to the oil grooves 11 in the large diameter portion 3*b* of the piston 3, which grooves 11 are in contact with the cylinder 5.

Now, description will be given to the case where the hydraulic pump or motor of the invention is used as a hydraulic motor.

Figure 5:
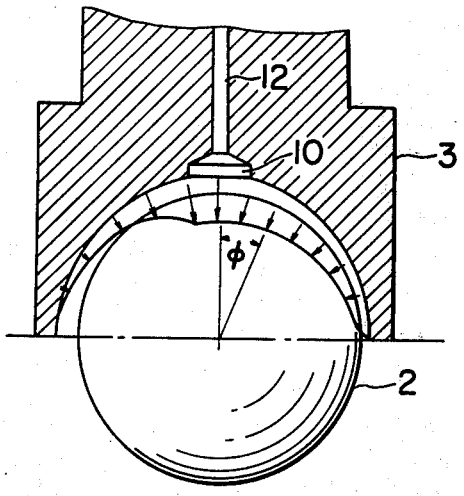
FIGS. 5 and 6 are diagrams showing the relations between oil-film pressure distribution and pressure difference.
Figure 6:
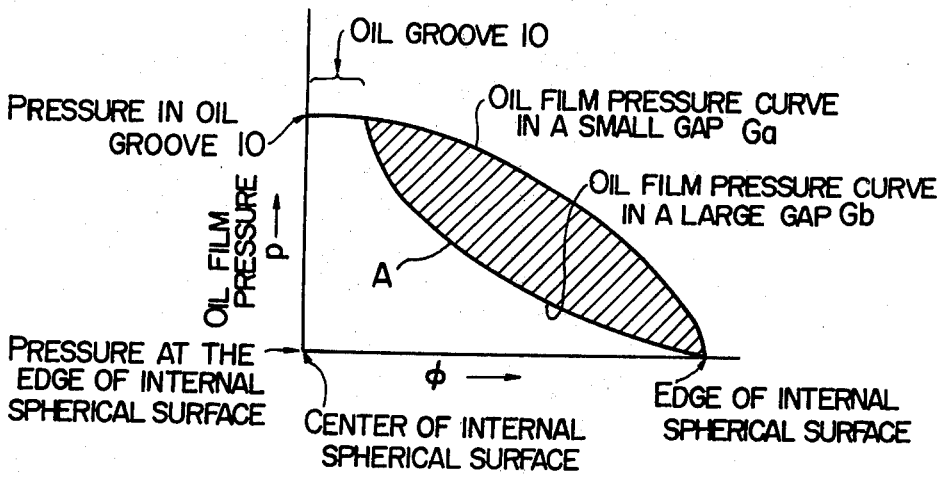

As shown in FIG. 2, when the ball 2 is positioned on the slope N of a wave-form cam surface 1 and goes down from the top M of the slope therealong, then the piston 3 and ball 2 will be subjected to a reaction force F from the slope N of the cam surface 1. The component Fx of the reaction force F in a direction at a right angle with regard to the axis of the piston will cause the large diameter portion 3*b* of the piston 3 as well as the ball 2 to be urged to the right as viewed in FIG. 2. This produces a small gap Ga between the ball and the internal partial-spherical surface 7 of piston 3 on the righthand side thereof. In this respect, the quantity of flow of pressure oil to be fed through small diameter passage 12 and oil groove 10 will be decreased. In contrast, there will be produced a gap Gb larger than Ga, between the ball 2 and the pistons 3 on the lefthand side thereof. Accordingly, the quantity of the flow of pressure oil to be fed through the small diameter passage 12 and oil groove 10 will be increased. It follows that the pressure generated in the gap Gb will become higher than in the gap Ga. This presents an oil film pressure distribution in the gap between the internal partial-spherical surface 7 of the piston 3 and the ball 2, as shown in FIG. 5, and the pressure difference between the righthand portion and the left hand portion of the internal partial-spherical surface, as shown in FIG. 6. The pressure difference over the oil film, that is the pressure in the hatched portion A in FIG. 6 acts on the ball 2 so as to force same back to the left, whereby an appropriate oil film may be produced between the ball 2 and the internal partial-spherical surface 7, while said pressure difference balances the component Fx of the reaction force F.

On the other hand, the ball 2 will be urged upwardly due to a component Fy of the reaction force F in an axial direction of the piston 3. When the ball 2 is forced upwardly, the gap Gc between the center portion of the internal partial-spherical surface 7 of the piston 3 and the ball 2 will become smaller and thus the quantity of flow of pressure oil to be fed to the gap Gc through small diameter passage 12 and oil groove 10 will be decreased, with the result that a pressure drop across the necked portion 14 will become smaller. This presents a high pressure about said oil groove 10, thereby forcing the ball 2 downwardly and producing an appropriate oil film between the center portion of the internal partial-spherical surface 7 and the ball 2 as well as balancing the component Fy of the reaction force F. In this respect, the oil film pressure *p* generated about the center portion of the internal partial-spherical surface 7 and between the ball and the internal partial-spherical surface 7, as shown in FIG. 5, exerts a force to urge the ball 2 back in the axial direction of the piston, so that the oil film pressure *p*, which acts on the side portion of the surface 7, contributes substantially in balancing the component Fx of reaction force F, but partly in balancing the component Fy.

On the other hand, the piston 3 receiving or mounting the ball 2 thereon is urged to the right by the component Fx of the reaction force F, as shown in FIG. 2. When the large diameter portion 3*b* of the piston 3 is urged to the right toward the cylinder 5 in this manner, there will be produced a small gap Ha between the large diameter portion 3*b* of the piston 3 and the cyliner 5 on the righthand portion thereof, and a relatively large gap Hb between the large diameter portion 3*b* of the piston 3 and the cylinder 5 on the lefthand portion thereof in the same manner as that in which the oil film is produced on the internal partial-spherical surface 7. The difference in the oil film pressure generated in those portions in turn causes the piston 3 to be urged back to the left against the reaction force F. It follows that there is produced an appropriate oil film between the large diameter portion 3*b* of the piston and the cylinder 5, thereby improving sliding characteristics for the piston 3 and cylinder 5 which are arranged in sliding relation to each other.

In the above embodiment, the oil grooves are formed in the outer peripheral surface of the large diameter portion 3*b* of the piston 3. It is to be understood that the oil grooves may be of any shape other than those shown, or may be of a series of small holes.

Figure 7:
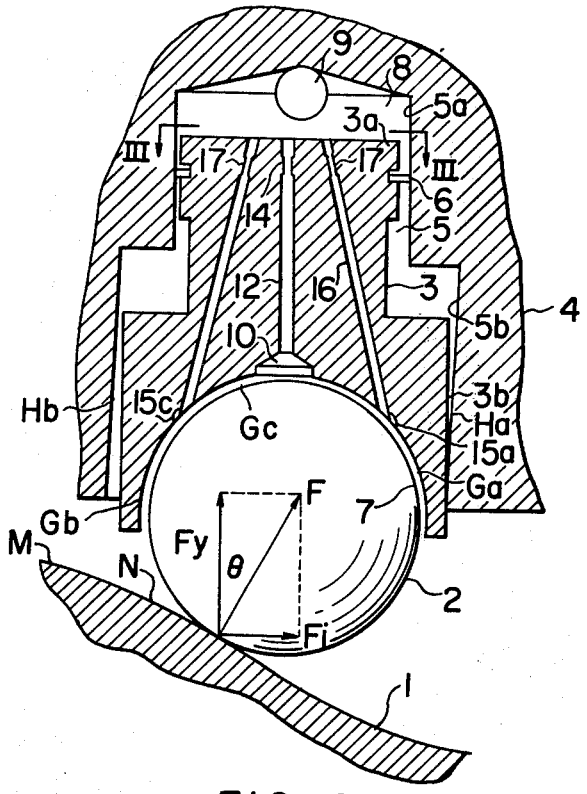
FIG. 7 is a view showing another embodiment of the piston portion of a hydraulic pump or motor of the present invention.
Figure 8:
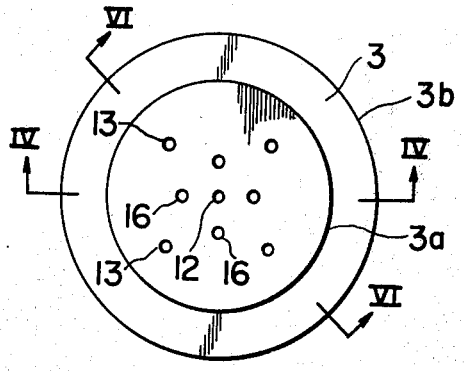
FIG. 8 is a view taken along the line III—III of FIG. 7.

Now, description will be given to the second embodiment of the invention with reference to FIGS. 7 to 16. FIGS. 7 and 8 show a piston portion of a hydraulic pump or motor taken as the second embodiment of the invention. In these FIGS., the parts which are similar in FIGS. 1 to 4 are given the same reference numerals.

Figure 9:
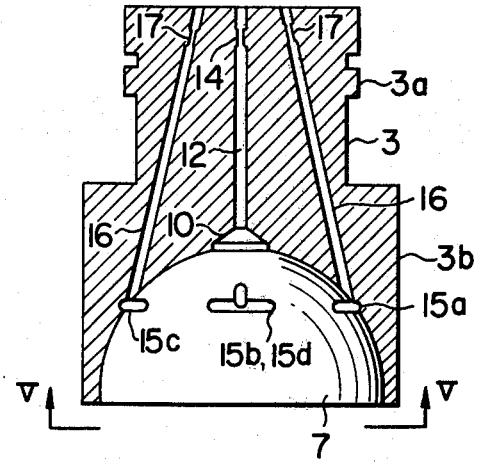
FIG. 9 is a cross-sectional view taken along the line IV—IV of FIG. 8.
Figure 10:
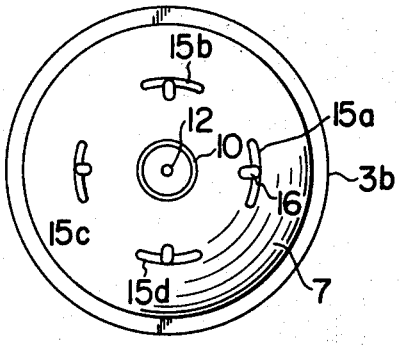
FIG. 10 is a cross-sectional view taken along the line V—V of FIG. 9.
Figure 11:
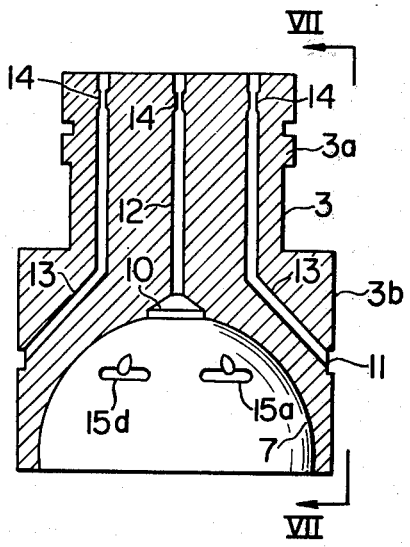
FIG. 11 is a cross-sectional view taken along the line VI—VI of FIG. 8.
Figure 12:
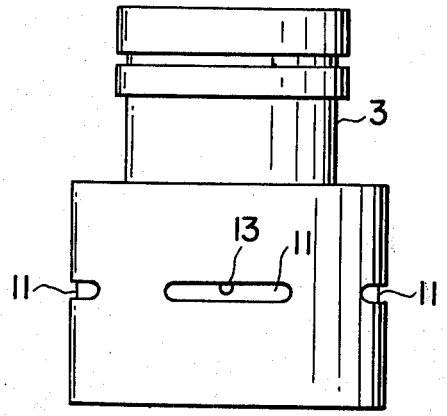
FIG. 12 is a cross-sectional view taken along the line VII—VII of FIG. 11.

As shown in FIGS. 9 and 10, there are provided oil grooves 15*a* to 15*d* in the internal partial-spherical surface 7, the grooves being located in the side portion of the surface 7, and spaced equally circumferentially in a plane perpendicular to the axis of the piston 3. The oil grooves 10; 15*a* to 15*d* and 11 are in communication through small diameter passages 12, 13 and 16 formed in the piston 3 with the oil chamber 8 for the piston 3, as shown in FIGS. 9 and 11. There are provided necked or throttle portions 14 and 17 in said small diameter passages 12, 13 and 16 close to the side of the oil chamber 8 for the piston 3. For the reason as has been described in conjunction with the first embodiment, the necked portions 14 and 17 serve to feed high pressure oil to the oil grooves in the internal partial-spherical surface 7, the grooves facing the ball 2 that is being urged by the reaction force thereagainst, as well as to the oil grooves in the large diameter portion 3*b* of the piston 3, the grooves being in contact with the cylinder 5. In the second embodiment, there are provided oil grooves 15*a* to 15*d* in the internal partialspherical surface 7, the grooves being located radially outwardly from the center of the surface in circumferentially equally spaced relation. Also, there are provided oil grooves 11 in circumferentially equally spaced relation on the outer peripheral surface of the large diameter portion 3b of the piston 3.

Now, description will be given to the case wherein the hydraulic pump or motor in the second ebmodiment is used as a hydraulic motor.

Figure 13:
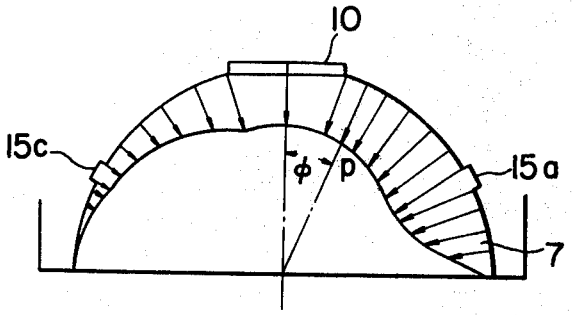
FIGS. 13 and 14 are graphs showing oil-film pressure distributions and pressure differences between a ball and an internal partial-spherical surface, when the ball is subjected to a reaction force.

As in the case of the first embodiment, when the ball 2 is positioned on the slope N of a wave-form c cam surface 1 and goes down therealong from the top M of the slope, there will be produced a small gap Ga between the ball 2 and the internal partial-spherical surface 7 of the piston 3 on the righthand portion thereof, so that the quantity of flow of pressure oil to be fed to the small gap Ga through small diameter passage 16 and oil groove 15*a* will be decreased. Thus, there will result small pressure drop across the necked portion 17 in the small diameter passage 16. The value of the pressure in oil groove 15*a* which faces the gap Ga will become close to that of the pressure in the oil chamber 8. On the other hand, the quantity of flow of pressure oil to be fed to the gap Gb, through the small diameter passage 16 and oil groove 15*c* will be increased, so that the pressure drop across the necked portion 17 in the small diameter passage 16 will be greater. In this respect, the gap Gb defined between the ball 2 and the internal partial-spherical surface 7 of the piston on the lefthand portion thereof is larger than the gap Ga. It follows then that the pressure p generated about the oil groove 15*c* in gap Gb will be lower than that generated about the oil groove 15*a* in gap Ga. As a result, as shown in FIGS. 13 and 14, there will be presented oil film pressure distribution and pressure difference throughout the gap between the piston 3 and the ball 2.

Figure 14:
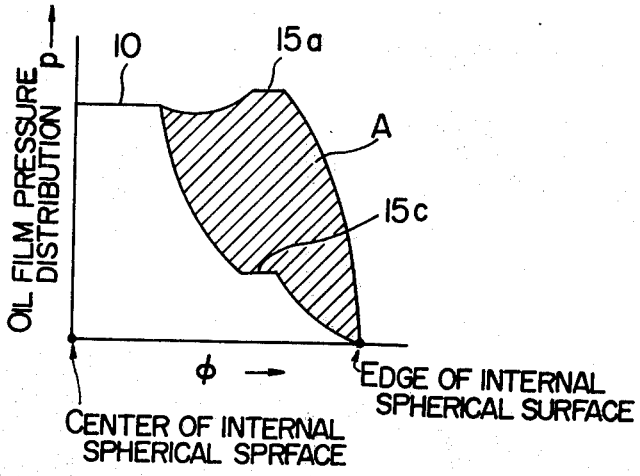

Thus, the difference in oil film pressures, that is, the pressure in a hatched portion A of FIG. 14 will exert a force to urge the ball 2 back to the left, thereby producing an appropriate oil film between the ball 2 and the internal partial-spherical surface 7 throughout the gap, and balancing the component Fx of the reaction force F.

As in the first embodiment, the pressure drop across the necked portion 14 in small diameter passage 12 will be smaller, so that the pressure in the oil groove 10 will become higher to urge ball 2 downwardly, thereby providing an appropriate oil film between the ball 2 and the center portion of the internal partial-spherical surface 7, and balancing the component Fy of the reaction force F. The oil film pressure p about the center portion of the internal partial-spherical surface 7 between the ball 2 and the internal partial-spherical surface 7 exerts a force to urge the ball 2 back in an axial direction of the piston and contributes substantially in balancing the component Fx of the reaction force F, and partially in balancing the component Fy of the reaction force F. It will be noted that the extent of the force of contributing in balancing the components Fx and Fy in the case of the second embodiment is greater than that in the case of the first embodiment, as can be seen from the comparison of FIG. 5 with FIG. 13. In short, when the ball 2 is urged against the internal partial-spherical surface 7 sidewise by the component Fx of the reaction force F, high pressure oil is introduced over the internal partial-spherical surface 7 due to the action of the necked portion 17. On the other hand, when the ball 2 is urged against the center portion of the internal partial-spherical surface 7 due to the component Fy of the reaction force F, then high pressure oil will be introduced into the center portion of the internal partial-spherical surface 7 due to the action of the necked portion 14, thereby producing an appropriate oil film between the ball 2 and the internal partial-spherical surface 7.

As in the first embodiment, there will be produced an appropriate oil film between the large diameter portion 3*b* of the piston 3 and the cylinder 5 thereby providing improved sliding characteristics therefor.

Now, description will be given on the tests for sliding characteristics of the hydraulic pump or motor in the second embodiment.

In these tests, the sliding characteristics of the ball 2 and internal partial-spherical surface 7, which were arranged in sliding relation, were investigated in the following manner. The piston 3 mounting the ball 2 thereon was fixed rigidly, and a cam plate was brought into contact with the ball 2 in a manner that the reaction force F will act on the ball at an angle $\theta$ with regard to the axis of the piston as shown in FIG. 2. In addition, the ball was rotated by virtue of the rotation of the cam plate, while the oil pressure acting in the oil chamber 8 for the piston 3 was increased stepwisely in order to measure coefficient of friction between the ball 2 and the internal partialspherical surface 7. On the other hand, the sliding characteristics of the large diameter portion 3*b* and the cyliner 5, which were arranged in sliding relation, was measured in the following manner. The rotor 4 provided with cylinder 5 was fixed rigidly, while the piston 3 which mounted the ball 2 thereon was slidably placed in the cylinder 5 of the rotor 4. The eccentric cam plate was brought into contact with the ball 2 in such a manner that, as in the previous case, the reaction force F would act on the ball at an angle $\theta$ with regard to the axis of the piston. The piston 3 was caused to slide with the cylinder 5 by rotation of the eccentric cam plate, while the oil pressure acting in the oil chamber 8 for the piston 3 was increased stepwisely in order to measure coefficient of friction between the large diameter portion 3*b* of the piston 3 and the cylinder 5.

Figure 15:
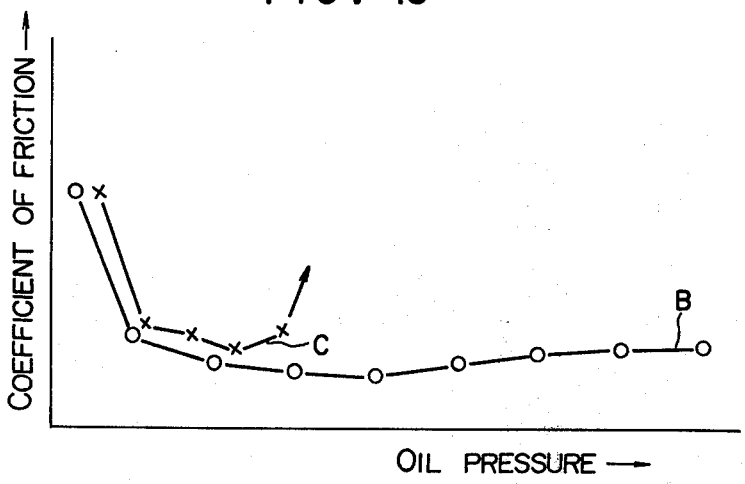
FIG. 15 is a plot showing sliding characteristics of the ball and the internal partial-spherical surface which are arranged in sliding relation to each other.
Figure 16:
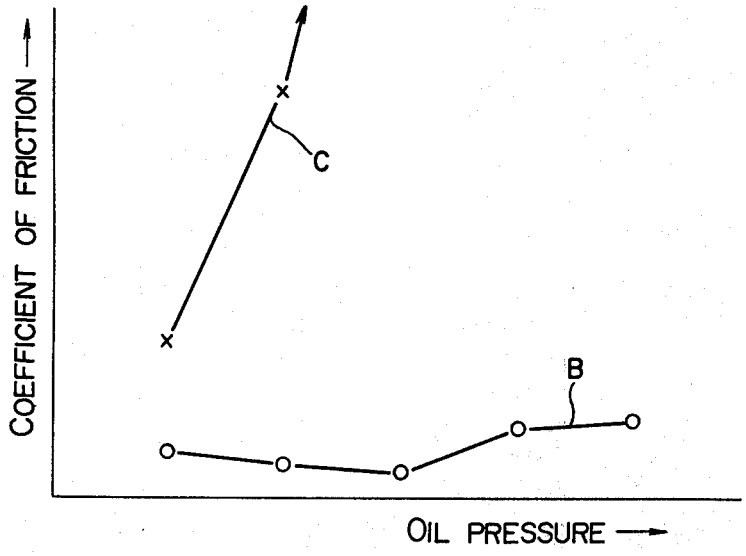
FIG. 16 is a plot showing sliding characteristics of the piston and the cylinder which are arranged in sliding relation to each other.

FIG. 15 shows the sliding characteristics of the ball 2 and internal partial-spherical surface 7 which were arranged in sliding relation, while FIG. 16 illustrates the sliding characteristics of the large diameter portion 3*b* of the piston 3 and the cylinder which were arranged in sliding relation. In these graphs, a curve B represents the case with a piston provided with oil grooves and small diameter passages, that is, the piston of the present invention, while a curve C represents the case with a piston devoid of oil grooves and small diameter passages, that is, a conventional type piston. As is apparent from the results of the tests, in the case of the use of the conventional type piston, the coefficient of friction between the ball 2 and the internal partial-spherical surface 7, that is, between the large diameter portion 3*b* and the cylinder 5 will be sharply increased, when the oil pressure acting in the oil chamber 8 for the piston 3 is relatively low, with the resultant interference therebetween. However, in the case of the use of the piston according to the present invention, the coefficient of friction is maintained relatively smaller, without causing any interference.

Here, it is to be understood that, although the embodiments described heretofore are associated with radial piston type hydraulic pumps or motors, the present invention can be employed in axial piston type hydraulic pumps or motors.

As is apparent from the foregoing description, the present invention presents improved sliding characteristics for a combination of the ball and the internal partial-spherical surface of the piston which are arranged in sliding relation as well as for a combination of the piston and the cylinder, whereby long service lives of piston and ball may be ensured. In addition, the resultant smooth lubrication on the aforesaid sliding surfaces results in improved torque efficiency of the hydraulic pump or motor, while there also results improved starting torque in the low speed high torque type hydraulic pump or motor. Still furthermore, according to the present invention, all the small diameter passages are arranged only in the piston for feeding pressure oil to sliding portions of the ball and internal partial-spherical surface as well as of the piston and cylinder, so that the manufacture and machining thereof may be readily accomplished, resulting in a great advantages in the practical application.

What is claimed is:

1. A hydraulic pump or motor comprising:

a casing having a cam surface thereon, a cylinder block mounted in the casing and having at least one cylinder, a piston arranged in said cylinder for reciprocating movement therein and formed with an internal partial-spherical surface on an end portion thereof, roller means rotatably mounted on the partial-spherical surface of said piston for rolling movement on the cam surface, a plurality of oil grooves on the internal partial-spherical surface, a plurality of oil grooves on outer peripheral surfaces of a portion of said piston which portion is guided in said cylinder, and small diameter passages extending through said piston for connecting the respective oil grooves with an oil chamber, wherein said cylinder is of stepped configuration with an inner portion of small cross-section communicating with and forming a portion of said oil chamber and an outer portion of larger cross-section, wherein said piston is of stepped configuration with an inner portion of small cross-section slideably guided in the inner portion of the associated cylinder and an outer portion of larger cross-section guided in the outer portion of the associated cylinder, and wherein all of the oil grooves on the outer peripheral surface of said piston are on the outer portions of said piston, wherein each of said internal partial-spherical surfaces are formed on the outer portions of the piston, wherein a plurality of said oil grooves are provided spaced from one another in each of said internal partialspherical surfaces, wherein separate oil passages are provided on said piston between said oil chamber and each of the oil grooves on said internal partial-spherical surfaces, these last-mentioned separate oil passages each including narrow throttling necked portions, and wherein a plurality of said oil grooves are provided spaced from one another on the outer peripheral surface of said piston, wherein separate oil passages are provided in said piston between said oil chamber and each of the oil grooves on said outer peripheral surfaces, wherein all of said oil passages are disposed in said piston.

2. A pump or motor according to claim 1, wherein all of said oil passages include narrow throttling sections.

3. A pump or motor according to claim 1, wherein said cyliner block has a plurality of said cylinders with a corresponding plurality of said pistons.

4. A pump or motor according to claim 2, wherein said cylinder block has a plurality of said cylinders with a corresponding plurality of said pistons.

5. A pump or motor according to claim 3, wherein said cylinder block is rotatably mounted in the casing, and wherein each of said cylinders extends radially with respect to the axis of rotation of the cylinder block.

6. A pump or motor according to claim 4 wherein said cylinder block is rotatably mounted in the casing, and wherein each of said cylinders extends radially with respect to the axis of rotation of the cylinder block.

* * * * *